US009515434B2

(12) United States Patent
Lee et al.

(10) Patent No.: US 9,515,434 B2
(45) Date of Patent: Dec. 6, 2016

(54) CONNECTOR PLUG WITH TWO ROWS OF PINS AND CONNECTOR SOCKET WITH TWO ROWS OF HOLES

(71) Applicant: SAMSUNG ELECTRONICS CO., LTD., Suwon-si (KR)

(72) Inventors: Jin Lee, Suwon-si (KR); Kyeong-jae Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/753,766

(22) Filed: Jun. 29, 2015

(65) Prior Publication Data

US 2015/0380884 A1 Dec. 31, 2015

(30) Foreign Application Priority Data

Jun. 27, 2014 (KR) ..... 10-2014-0079485

(51) Int. Cl.

| | |
|---|---|
| ***H01R 24/00*** | (2011.01) |
| ***H01R 24/60*** | (2011.01) |
| *H01R 13/6471* | (2011.01) |
| *H01R 107/00* | (2006.01) |

(52) U.S. Cl.

CPC ..... *H01R 24/60* (2013.01); *H01R 13/6471* (2013.01); *H01R 2107/00* (2013.01)

(58) Field of Classification Search

CPC ..... H01R 24/60; H01R 13/6471
USPC ..... 439/660, 676
See application file for complete search history.

(56) References Cited

U.S. PATENT DOCUMENTS

| | | | | |
|---|---|---|---|---|
| 6,190,190 | B1 | 2/2001 | Daly et al. | |
| 7,555,582 | B2 * | 6/2009 | Lambert | G11C 5/005 710/62 |
| 2010/0109795 | A1 | 5/2010 | Jones et al. | |
| 2012/0000705 | A1 | 1/2012 | Cornelius et al. | |
| 2013/0164994 | A1 | 6/2013 | Pachón | |

FOREIGN PATENT DOCUMENTS

KR 10-0806905 B1 2/2008

OTHER PUBLICATIONS

Machine Translation of KR 10-0806905.*
Search Report issued Oct. 23, 2015, issued by the International Searching Authority in counterpart International Patent Application No. PCT/KR2015/006597 (PCT/ISA/210).
Written Opinion issued Oct. 23, 2015, issued by the International Searching Authority in counterpart International Patent Application No. PCT/KR2015/006597 (PCT/ISA/237).

* cited by examiner

*Primary Examiner* — Javaid Nasri
(74) *Attorney, Agent, or Firm* — Sughrue Mion, PLLC

(57) ABSTRACT

A connector plug is provided. The connector plug includes: a first pin set positioned in a first row of the connector plug, which is configured to transmit and receive a data signal; and a second pin set positioned in a second row of the connector, which is configured to transmit and receive a data signal. Pins of the first pin set that belong to same type of pins of the second pin set, are positioned symmetrically with respect to the pins of the second pin set.

20 Claims, 6 Drawing Sheets

CONNECTOR PLUG WITH TWO ROWS OF PINS AND CONNECTOR SOCKET WITH TWO ROWS OF HOLES

CROSS-REFERENCE TO RELATED APPLICATION(S)

This application claims priority under 35 U.S.C. §119 from Korean Patent Application No. 10-2014-0079485, filed on Jun. 27, 2014, in the Korean Intellectual Property Office, the disclosure of which is incorporated herein by reference in its entirety.

BACKGROUND

1. Field

An apparatus consistent with exemplary embodiments generally relates to a connector, and more particularly, to a connector structure that transmits and receives audio/video (AV) data at high speed.

2. Description of the Related Art

Various types of connectors for physical connections between devices have been recently developed. For example, a connector design for a wire interface, such as a high definition multimedia interface (HDMI), a digital video/visual interface (DVI), a mobile high-definition link (MHL) or the like, has been developed. The HDMI is one of incompressible digital video/audio interface standards. The MHL is similar to the HDMI and is a high-speed wire interface standard that connects a mobile device to a TV. The DVI is a wire interface standard that digitizes a video image, and transmits and receives the digitized video image. A connector that complies with standards as described above may rapidly transmit and receive high-capacity data between a multimedia source, such as a smartphone, a set-top box, a digital versatile disc (DVD) player, or the like, and sink devices such as an audio/video (AV) device, a monitor, a digital TV, etc.

The connector transmits and receives data through a connector plug, and transmits and receives the data through a connector socket (i.e., a connector receptacle) that is connected to the connector plug. Since the connector plug and the connector socket are to be physically combined with each other or connected to each other, the connector plug includes a plurality of pins, and the connector socket includes a plurality of pin holes corresponding to the plurality of pins. If the connector plug and the connector socket are combined with each other, the pins of the connector plug are inserted into the pin holes of the connector socket that respectively correspond to the pins.

However, since a direction in which the connector needs to be combined is determined as an upper direction, a lower direction, or the like, it is inconvenient for a user to combine the connector according to a particular direction. For example, if a connector plug having pins arranged in the order from 1 to 10 is combined with a connector socket corresponding to the connector plug, a first pin of the connector plug may be inserted into a first pin hole of the connector socket. Therefore, the direction in which the connector is connected is fixed, and thus it is inconvenient to use the connector.

An existing HDMI connector is designed to enable one differential pair pin set, which includes a + pin, a − pin, and a ground pin for transmitting and receiving AV data, to have a transmission and reception speed of 6 Gbps. Since the existing HDMI connector has three high-speed data transmission and reception pairs, the existing HDMI is mainly appropriate for transmitting and receiving full HD (1080p) of 60 Hz and may transmit and receive only 2D image data of maximum 4K. However, recent developments in image technologies demand a new connector structure that may support a 4K-3D image, an 8K-2D image, an 8K-3D image, or the like.

Therefore, there is a need for a connector structure that may efficiently transmit and receive high-capacity data and which is convenient to use for a user.

SUMMARY

Exemplary embodiments address at least the above problems and/or disadvantages and other disadvantages not described above. Also, the exemplary embodiments are not required to overcome the disadvantages described above, and an exemplary embodiment may not overcome any of the problems described above.

Exemplary embodiments provide a connector structure, which is easy to use and which efficiently transmits and receives high-capacity data.

According to an aspect of exemplary embodiments, there is provided a connector plug including: a first pin set which is positioned in a first row of the connector plug, and is configured to transmit and receive a first data signal; and a second pin set which is positioned in a second row of the connector plug, and is configured transmit and receive a second data signal. Pins of the first pin set that belong to same types as pins of the second pin set, are positioned symmetrically to the pins of the second pin set.

Each of the first and second pin sets may include: a first pin configured to transmit and receive a power signal; a second pin configured to transmit and receive a control signal; and at least two differential pair pin sets configured to transmit and receive an audio and/or video (AV) data signal.

Each of the plurality of differential pair pin sets may include a + signal pin, a − signal pin, and a ground pin.

The + signal pin, the − signal pin, and the ground pin may be sequentially arranged.

Each of the first and second pin sets may further include pins that comply with one or more universal serial bus (USB) standards.

The second pin may transmit and receive at least one of a control signal, an identification signal, and a combination direction determination signal.

The at least two of the differential pair pin sets may include eight differential pair pin sets configured to transmit and receive data at a high speed such as about 20 Gb per second.

Both ends of the first pin set may mismatch both ends of the second pin set.

The ground pin of the second row of the connector plug may be positioned between the + signal pin and the − signal pin of the first row of the connector plug.

According to yet another aspect of exemplary embodiments, there is provided a connector socket including: a first pin hole set positioned in a first row of the connector socket to transmit and receive a first data signal; a second pin hole set positioned in a second row of the connector socket to transmit and receive a second data signal. Pin holes of the first pin hole set that belong to same type of pin holes of the second pin hole set, are positioned symmetrically to the pin holes of the second pin hole set.

Each of the first and second pin hole sets may include: a first pin hole configured to transmit and receive a power signal; a second pin hole configured to transmit and receive a control signal; and at least two differential pair pin hole sets configured to transmit and receive an AV data signal.

Each of the plurality of differential pair pin hole sets may include a + signal pin hole, a − signal pin hole, and a ground pin hole.

The + signal pin hole, the − signal pin hole, and the ground pin hole may be sequentially arranged.

Each of the first and second pin hole sets may further include pin holes that comply with one or more USB standards.

The second pin hole may transmit and receive at least one of a control signal, an identification signal, and a combination direction determination signal.

The at least two differential pair pin hole sets may include eight differential pair pin hole sets configured to transmit and receive data at a high speed such as 20 Gb per second.

Both ends of the first pin hole set may mismatch both ends of the second pin hole set.

The ground pin hole of the second row of the connector socket may be positioned between the + signal pin hole and the − signal pin hole of the first row of the connector socket.

According to yet another aspect of exemplary embodiments, there is provided a connector plug including: a first row pin set; and a second row pin set. The first row pin set may include: a first volumetric bladder ultrasound (VBUS) GND pin configured to transmit and receive a first ground signal; a first Enhanced Control BUS (eCBUS) pin configured to transmit and receive a first control signal; a first eCBUS GND pin; a Data1/0+ pin configured to transmit and receive first AV data or second AV data at a speed higher than 6 Gb per second; a Data1/0− pin; a Data1/0 GND pin; a USB#0 D+ pin configured to transmit and receive a data signal according to a USB standard; a USB#0 D− pin; a USB#0 GND pin; a Data2/3+ pin configured to transmit and receive third AV data or fourth AV data at this speed; a Data2/3− pin; a Data2/3 GND pin; a Data4/5+ pin configured to transmit and receive fifth AV data or sixth AV data; a Data4/5− pin; a Data4/5 GND pin; and a second VBUS pin configured to transmit and receive a second power signal of second power. The second row pin set may include: a first VBUS pin configured to transmit and receive a first power signal of first power; a Data5/4 GND pin configured to transmit and receive the sixth AV data or the fifth AV data at this speed; a Data5/4− pin; a Data5/4+ pin; a Data3/2 GND pin configured to transmit and receive the fourth AV data or the third AV data at this speed; a Data3/2− pin; a Data3/2+ pin; a USB#1 GND pin configured to transmit and receive a data signal according to a USB standard; a USB #1 D− pin; a USB #1 D+ pin; a Data0/1 GND pin configured to transmit and receive the second AV data or the first AV data at this speed; a Data0/1− pin; a Data0/1+ pin; a second eCBUS GND pin configured to transmit and receive a ground signal of a second control signal; a second eCBUS pin configured to transmit and receive the second control signal; and a second VBUS GND pin configured to transmit and receive a ground signal of the second power.

BRIEF DESCRIPTION OF THE DRAWINGS

The above and/or other aspects will be more apparent and more readily appreciated by describing from the following description of exemplary embodiments with reference to the accompanying drawings, in which.

DETAILED DESCRIPTION OF EXEMPLARY EMBODIMENTS

Figure 1A:
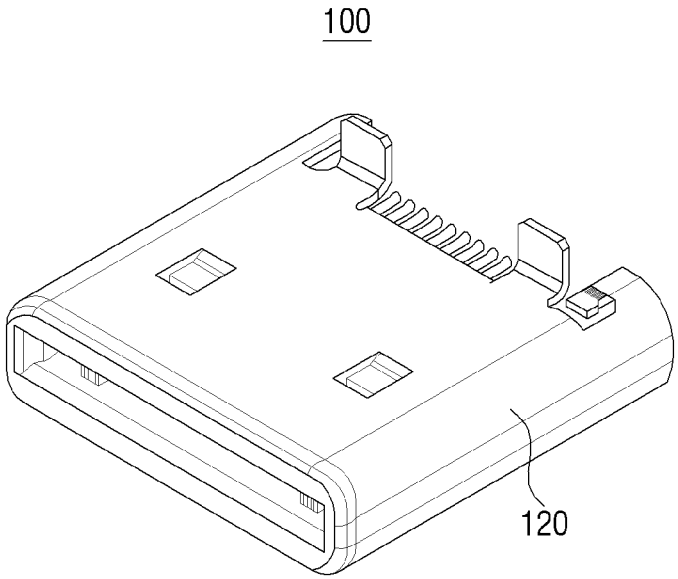
FIGS. 1A and 1B are perspective views illustrating an outer structure of a connector plug according to an exemplary embodiment.

Exemplary embodiments are described in greater detail with reference to the accompanying drawings.

In the following description, the same drawing reference numerals are used for analogous elements even in different drawings. The matters defined in the description, such as detailed construction and elements, are provided to assist in a comprehensive understanding of exemplary embodiments. Thus, it is apparent that the exemplary embodiments can be carried out without those specifically defined matters. Also, well-known functions or constructions are not described in detail since they would obscure exemplary embodiments with unnecessary detail.

A connector structure according to various exemplary embodiments may be realized to support various types of high-speed wire interfaces. For example, a connector structure according to exemplary embodiments may be realized to support at least one selected from among a mobile high-definition link (MHL) interface, a high definition multimedia interface (HDMI), a digital interactive interface for video and audio (DiiVA), and a digital video/visual interface (DVI).

Figure 1B:
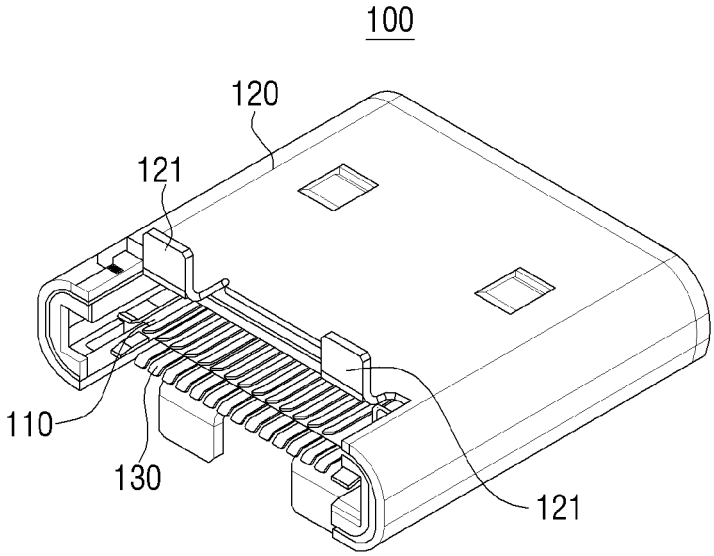
Figure 2:
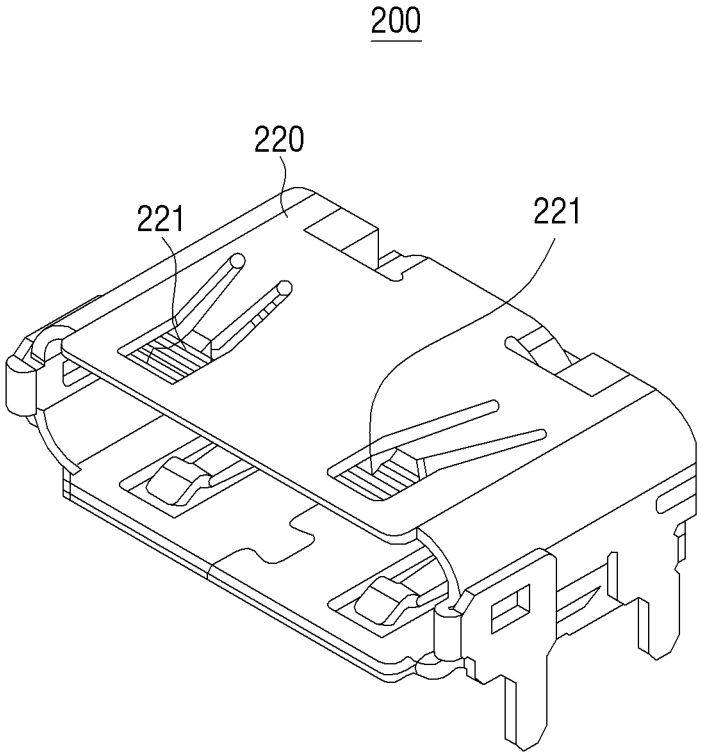
FIG. 2 is a view illustrating an outer structure of a connector socket according to an exemplary embodiment.

FIGS. 1A and 1B are perspective views illustrating an outer structure of a connector plug 100 according to an exemplary embodiment. FIG. 2 is a view illustrating an outer structure of a connector socket 200 according to an exemplary embodiment.

FIG. 1A is a perspective view illustrating a back side of the connector plug 100 according to an exemplary embodiment. FIG. 1B is a perspective view illustrating a front side of the connector plug 100 according to an exemplary embodiment.

Referring to FIGS. 1A and 1B, the connector plug 100 includes a substrate 110 on which a plurality of pins 130 are formed and a housing 120 which houses the substrate 110. According to an exemplary embodiment, the plurality of pins 130 are used to transmit and receive a signal between devices.

The substrate 110 enables the plurality of pins 130 to maintain preset distances from one another so as to fix the plurality of pins 130 in a predetermined location and spaced apart from one another. If the connector plug 100 is inserted into the connector socket 200, the substrate 110 tightly fixes a connection part. If the connector plug 100 is connected to the connector socket 200, the plurality of pins 130 are elements that transmit a signal to pin holes of the connector sockets 200. The connection part between the connector plug 100 and the connector socket 200 may be formed of one selected from among gold-painting, and silver-painting, and nickel-painting.

The housing 120 houses the substrate 110 and the plurality of pins 130, and has protrusion parts 121 that tightly fix the housing 120 of the connector plug 100 into a housing 220 of the connector socket 200 (shown in FIG. 2) if the housing 120 is housed and combined into the connector socket 200. The protrusion parts 121 push up fixing bars 221 of the housing 220 of the connector socket 200 and enable the fixing bars 221 to return to their original positions through elasticity. Therefore, according to an exemplary embodiment, the protrusion parts 121 are locked into the fixing bars 221 to fix the connector plug 100 so that the connector plug 100 does not disconnect from the connector socket 200 unintentionally, as shown in FIG. 2. However, the housing 120 according to various exemplary embodiments is not limited to a mechanical structure described above and may have various types of structures configured to fixedly combine or connect the connector socket 200 and the connector plug 100 with each other. According to another exemplary embodiment, the housing 120 may not have an additional structure for fixedly combining or connecting the connector plug 100 with the connector socket 200. In this case, according to another exemplary embodiment, the connector plug 100 and the connector socket 200 are combined or connected with each other by using the substrate 110 and the plurality of pins 130 or by using only the plurality of pins 130.

Referring to FIG. 2, in an exemplary embodiment, the connector socket 200 includes a plurality of pin holes (not shown) for transmitting and receiving a signal between devices and the housing 220 that houses the plurality of pin holes.

The plurality of pin holes are dented so as to enable the plurality of pins of the connector plug 100 to be respectively inserted into the pin holes. Also, parts of the plurality of pin holes that contact the plurality of pins 130 may be formed of one selected from among gold-painting, silver-painting, tin-painting, and nickel-painting.

The housing 220 houses the plurality of pin holes and are dented to house the connector plug 100 so as to be combined or connected with the connector plug 100. The connector plug 100 is inserted into the dented space, and the plurality of pins 130 are inserted into the plurality of pin holes. The housing 220 may also include parts that may fixedly combine or connect the housing 120 of the connector plug 100 into the housing 220, for example, may include the fixing bars 221 shown in FIG. 2. The fixing bars 221 are formed to penetrate a surface of the housing 220 or protrude from an inside of the housing 220. Therefore, an entrance into the housing 220 becomes narrow so as to obstruct an insertion of the connector plug 100. If the connector plug 100 is inserted, the fixing bars 221 obstruct advancing of the protrusion parts 121 of the housing 120 of the connector plug 100. According to an exemplary embodiment, if a force is applied a little more toward a direction in which the connector plug 100 is inserted, the fixing bars 221 move to contact an inner wall of the housing 220 or to protrude outside the housing 220 in order to make space for the protrusion parts 121 of the connector plug 100 to be inserted into the housing 220. However, when the protrusion parts 121 pass by ends of the fixing bars 221, the fixing bars 221 return to their original positions due to elasticity and thus lock the protrusion parts 121 into the housing 220. As a result, the connector plug 100 is fixed with the housing 220 or fixedly inserted into the housing 220.

However, the housing 220 according to various exemplary embodiments is not limited to a mechanical structure described above and may have various types of structures which fixedly combine or connect the connector socket 200 and the connector plug 100 with each other. Also, according to another exemplary embodiment, the housing 220 may not have an additional structure for fixedly combining or connecting the connector plug 100 with the connector socket 200. In this case, the connector plug 100 and the connector socket 200 are combined with each other by using the substrate 110 and the plurality of pins 130 or by using only the plurality of pins 130.

Figure 3:
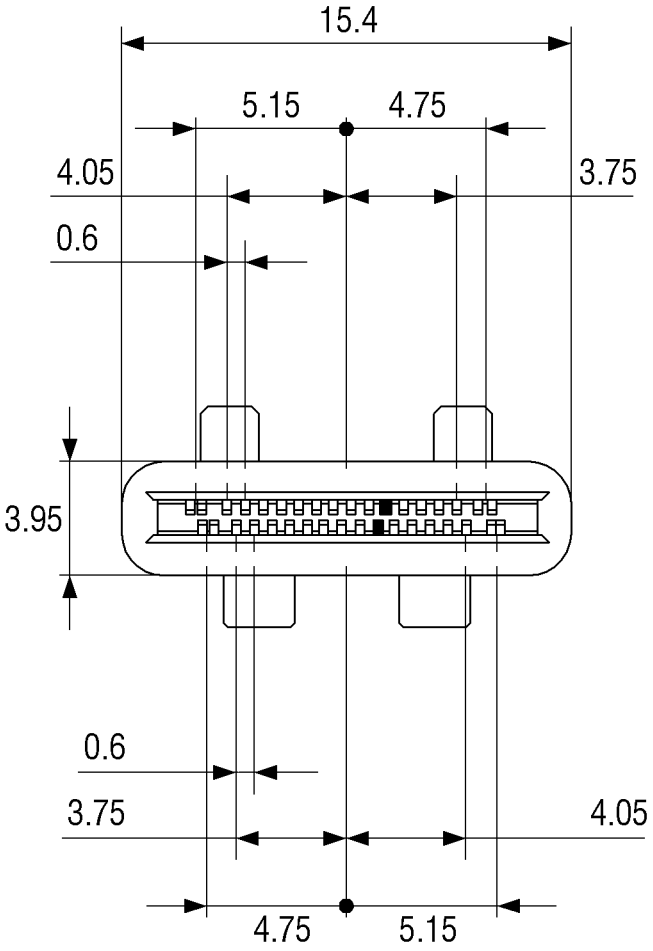
FIG. 3 is a front view of a connector plug according to an exemplary embodiment.
Figure 4:
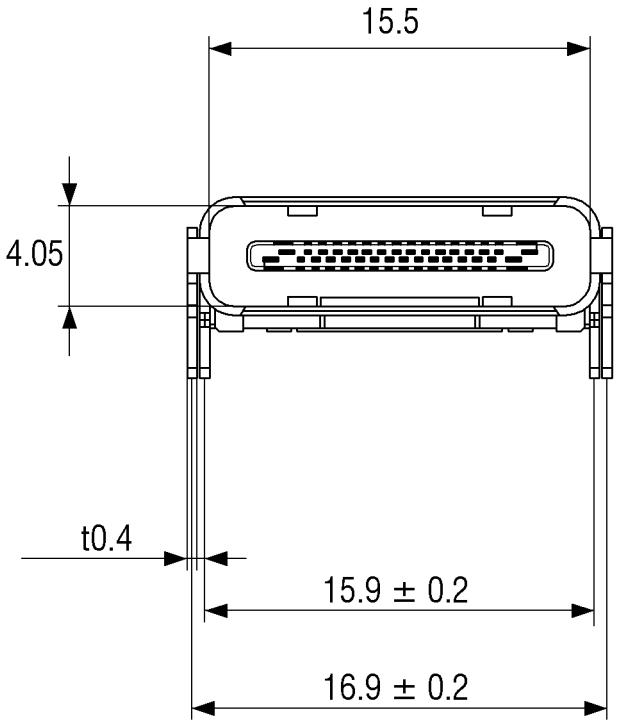
FIG. 4 is a front view illustrating a connector socket according to an exemplary embodiment.

FIG. 3 is a front view illustrating a connector plug according to an exemplary embodiment. FIG. 4 is a front view illustrating a connector socket according to an exemplary embodiment.

A connector structure according to an exemplary embodiment may be designed so as to enable each AV data pin to have a transmission and reception speed of 20 Gbps, and transmit and receive 8K-3D image data of maximum 240 Hz.

In this case, according to an exemplary embodiment, the connector plug 100 may be designed to have a height of 3.95 cm and a width of 15.4 cm. The connector socket 200 may be designed to have a height of 4.05 cm and include a housing having an internal width of 15.5 cm. A volumetric bladder ultrasound (VBUS) pin for supplying power may be formed to have a width of 0.8±0.03 mm. Also, a pin for supplying a signal except power may be formed to have a width of 0.3±0.03 mm. A distance between respective pins may be designed to be 0.6 mm.

Also, when an impedance is 100 ohm, an insertion loss may be −1.5 dB<10 GHz, and a crosstalk may be −30 dB or less.

Figure 5:
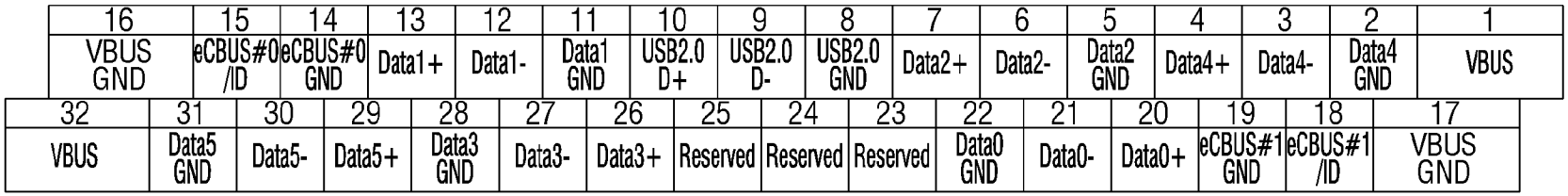
FIG. 5 is a view illustrating a pin arrangement of a connector plug according to an exemplary embodiment.

FIG. 5 is a view illustrating a pin arrangement of a connector plug 100 according to an exemplary embodiment.

Referring to FIG. 5, the connector plug 100 according to an exemplary embodiment has a pin set that is formed of two rows. In other words, the connector plug 100 includes a first pin set having first through sixteenth pins and a second pin set having seventeenth through thirty second pins. According to an exemplary embodiment, the first pin set is arranged in a first row, and transmits and receives a data signal, and the second pin set is arranged in a second row, and transmits and receives a data signal.

The first pin set in the first row may include a VBUS pin, a Data4 GND pin, a Data4− pin, a Data4+ pin, a Data2 GND pin, a Data2− pin, a Data2+ pin, a USB 2.0 GND pin, a USB 2.0 D− pin, a USB 2.0 D+ pin, a Data1 GND pin, a Data1− pin, a Data1+ pin, a eCBUS#0 GND pin, a eCBUS#0/ID pin, and a VBUS GND pin that are arranged in order of numbers 1 through 16, according to an exemplary embodiment, as shown in FIG. 5.

The second pin set in the second row may include a VBUS GND pin, a eCBUS#1/ID pin, a eCBUS#1 GND pin, a Data0+ pin, a Data0− pin, a Data0 GND pin, three reserved pins, a Data3+ pin, a Data3− pin, a Data3 GND pin, a Data5+ pin, a Data5− pin, a Data5 GND pin, and a VBUS pin that are arranged in order of numbers 17 through 32, according to an exemplary embodiment, as shown in FIG. 5.

The VBUS pin is a pin that transmits a power signal to a connector socket and/or receives the power signal from the connector socket, and the VBUS GND pin is a pin that transmits a ground signal of VBUS to the connector socket and/or receives the ground signal from the connector socket.

The eCBUS/ID pin may simultaneously transmit a clock signal and a normal data signal to a pin that transmits a bidirectional signal. The eCBUS/ID pin may also be used to transmit and receive at least one selected from among a control signal, a device identification signal of the connector plug 100, and a combination direction determination signal i.e., a signal indicating a direction in which the connector plug 100 and the connector socket 200 are connected.

As described above, according to an exemplary embodiment, the connector plug 100 may not additionally include pins respectively corresponding to a plurality of functions but may perform several functions through one pin. Therefore, a size of the connector plug 100 may be minimized, and transmission and reception efficiency may be improved.

The Data+ pin, the Data-pin, and the Data GND pin belong to a differential pair pin set for transmitting and receiving an AV data signal. The differential pair pin set transmits and receives AV data in a transition minimized differential signaling (TMDS) format. A TMDS transmits and receives an image, a voice, and additional data in an image data period, a data thumb period, and a control period. The TMDS transmits and receives pixel information of a moving picture line in the image data period, and transmits and receives additional information including voice information and a series of pieces in the data thumb period. The data thumb period occurs in a horizontal or vertical blanking period. The control period occurs between the image data period and the data thumb period.

The Data+ pin, the Data− Pin, and the Data GND pin may transmit and receive a total of six TMDSs from Data0 to Data5. Each differential signal pair may have a transmission and reception speed of 20 Gbps, and transmit and receive 8K-3D image data of maximum 240 Hz.

The Data+ pin, the Data− pin, and the Data GND pin may all transmit and receive a bidirectional signal but unidirectionally transmit and receive normal AV data.

The connector plug 100, according to an exemplary embodiment, has a characteristic in which the Data+ pin, the Data− pin, and the GND pin set are sequentially arranged. Since pins are sequentially arranged as described above, according to an exemplary embodiment, the size of the connector plug 100 may be made small, and data interference between adjacent pins may be minimized.

The USB GND pin, the USB D-pin, and the USB D+ pin are pins configured to transmit and receive data according to USB standards. Since the connector plug 100, according to an exemplary embodiment, includes the USB pins, the connector plug 100 may transmit and receive USB data and AV data using one connector without an additional USB connector.

Also, as shown in FIG. 5, according to an exemplary embodiment, both ends of the first pin set in the first row of the connector plug 100 may mismatch both ends of the second pin set in the second row of the connector plug 100. According to an exemplary embodiment, a ground pin of the second row of the connector plug 100 may be disposed between a + signal pin and a − signal pin arranged in the first row of the connector plug 100. As described above, according to an exemplary embodiment, if the ground pin of the second row is disposed between the Data+ pin and the Data− pin of the first row, a signal matching characteristic is improved, and thus, the connector plug 100 has an improved signal-to-noise ratio (SNR), according to an exemplary embodiment. Also, a connector manufacturing process becomes relatively simple, and wiring is easier when a connector is mounted on a printed circuit board (PCB), according to an exemplary embodiment.

Also, pins of the first pin set of the first row that belong to the same types as pins of the second pin set of the second row are symmetric to the pins of the second pin set. For example, the VBUS GND pin is disposed in a position of the seventeenth pin of the second row symmetric to the VBUS GND pint that is the sixteenth pin of the first row. Also, the VBUS pin is disposed in a position of the third second pin of the second row symmetric to the VBUS pin that is the first pin of the first row. Similarly, the eCBUS#1/ID pin and the eCBUS#1 GND pin are disposed in positions of eighteenth and nineteenth pins of the second row symmetric to the eCBUS#0/ID pin and the eCBUS#0 GND pin that are respectively fifteenth and fourteenth pins of the first row. Pins for transmitting and receiving AV data, the Data0+ pin, the Data0− pin, and the Data0 GND pin are disposed in positions of twentieth, twenty first, and twenty second pins of the second row symmetric to the Data1+ pin, the Data1− pin, and the Data1 GND pin that are respectively thirteenth, twelfth, and eleventh pins of the first row.

However, as shown in FIG. 5, in case of USB pins, positions of twenty third, twenty fourth, and twenty fifth pins of the second row may be left as reserved areas. If the twenty third, twenty fourth, and twenty fifth pins of the second row are left as the reserved areas, only a pair of USB signals is transmitted and received. USB signals are bidirectionally transmitted and received, according to an exemplary embodiment.

Figure 6:
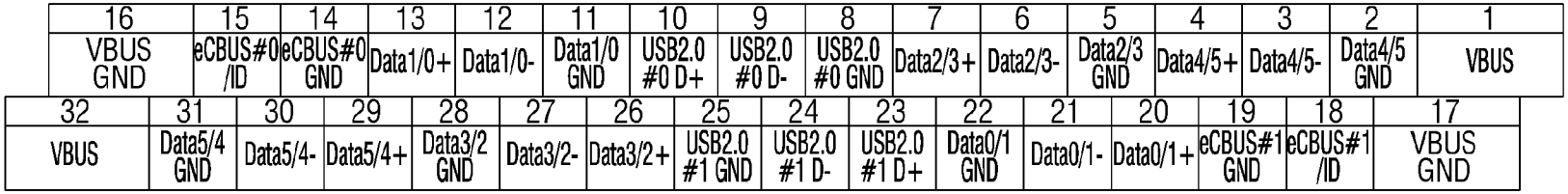
FIG. 6 is a view illustrating a pin hole arrangement of a connector socket according to an exemplary embodiment.

FIG. 6 is a view illustrating a pin hole arrangement of a connector socket according to an exemplary embodiment.

Referring to FIG. 6, the connector socket 200, according to an exemplary embodiment, has a pin hole set that is formed of 2 rows. In other words, the connector socket 200 includes a first pin hole set having first through sixteenth pins and a second pin hole set having seventeenth through thirty second pins. According to an exemplary embodiment, the first pin hole set is arranged in a first row of the connector socket 200, and transmits and receives a data signal, and the second pin hole set is arranged in a second row of the connector socket 200, and transmits and receives a data signal.

The first pin hole set of the first row may include a VBUS pin hole, a Data4/5 GND pin hone, a Data4/5− pin hole, a Data4/5+ pin hole, a Data2/3 GND pin hole, a Data2/3− pin hole, a Data2/3+ pin hole, a USB 2.0#0 GND pin hole, a USB 2.0 #0 D− pin hole, a USB 2.0#0 D+ pin hole, a Data1/0 GND pin hole, a Data1/0− pin hole, a Data1/0+ pin hole, a eCBUS#0 GND pin hole, a eCBUS#0/ID pin hole, and a VBUS GND pin hole that are arranged in order of numbers 1 through 16, respectively.

The second pin hole set of the second row may include a VBUS GND pin hole, a eCBUS#1/ID pin hole, a eCBUS#1 GND pin hole, a Data0/1+ pin hole, a Data0/1− pin hole, a Data0/1 GND pin hole, a USB 2.0 #1 D+ pin hole, a USB 2.0 #1 D− pin hole, a USB 2.0 #1 GND pin hole, a Data3/2+ pin hole, a Data3/2− pin hole, a Data3/2 GND pin hole, a Data5/4+ pin hole, a Data5/4− pin hole, a Data5/4 GND pin hole, and a VBUS pin hole that are arranged in order of numbers 17 through 32, respectively.

The VBUS pin hole is a pin hole that transmits a power signal to the connector plug 100 and/or receives the power signal from the connector plug 100, and the VBUS GND pin hole is a pin hole that is related to a ground signal of a VBUS.

The eCBUS/ID pin hole may simultaneously receive a clock signal and a normal data signal from a pin that transmits a bidirectional signal. Also, the eCBUS/ID pin hole may be used to transmit and receive at least one selected from among a control signal, a device identification signal of the connector plug 100, and a combination direction determination signal e.g., a signal indicating a direction in which the connector plug 100 and the connector socket 200 are connected.

As described above, according to an exemplary embodiment, the connector plug 100 may perform several functions through one pin without pins respectively corresponding to a plurality of functions in a one to one correspondence, for example. Therefore, a size of the connector socket 200 may be minimized, and transmission and reception efficiency may be improved.

The Data+ pin hole, the Data− pin hole, and the Data GND pin hole belong to a differential pair pin hole set for transmitting and receiving a data signal. The differential pair pin hole set transmits and receives AV data in a TMDS format. The TMDS transmits and receives an image, a voice, and additional data in an image data period, a data thumb period, and a control period. The TMDS transmits and receives pixel information of a moving picture line in the image data period, and transmits and receives additional information including voice information and a series of pieces in the data thumb period. A horizontal or vertical blanking period occurs in the data thumb period. The control period occurs between the image data period and the data thumb period.

The Data+ pin hole, the Data− pin hole, and the Data GND pin hole may transmit and receive a total of six TMDSs from Data0 to Data5. Each differential signal pair may have a transmission and reception speed of 20 Gbps, and enable 8K3-D image data of maximum 240 Hz to be transmitted and received, according to an exemplary embodiment.

The Data+ pin hole, the Data− pin hole, and the Data GND pin hole may all transmit and receive a bidirectional signal but may unidirectionally transmit and receive normal AV data.

Also, the connector plug 100, according to an exemplary embodiment, has a characteristic in which the Data+ pin hole, the Data− pin hole, and the GND pin hole set are sequentially arranged. Since pin holes are sequentially arranged, as described above, according to an exemplary embodiment, the size of the connector socket 200 may be made small, and data interference between adjacent pin holes may be minimized.

The USB GND pin hole, the USB D− pin hole, and the USB D+ pin hole are pin holes for transmitting and receiving data that comply with USB standards. As described above, according to an exemplary embodiment, the connector socket 200 includes USB pin holes and thus may transmit and receive USB data and AV data through one connector without an additional USB connector.

Also, as shown in FIG. 6, both ends of the first pin hole set of the first row of the connector socket 200 may mismatch both ends of the second pin hole set of the second row. According to an exemplary embodiment, a GND pin hole of the second row of the connector socket 200 may be disposed between a + signal pin hole and a − signal pin hole arranged in the first row of the connector socket 200. If a GND pin hole of the second row is disposed between a Data+ pin hole and a Data− pin hole of the first row as described above, a signal matching characteristic is improved, and thus the connector socket 200 has a good SNR, according to an exemplary embodiment. Also, a connector manufacturing process becomes relatively simple, and wiring is easy when a connector is mounted on a PCB, according to an exemplary embodiment.

Also, pin holes of the first pin hole set of the first row that belong to the same types as pin holes of the second pin hole set of the second row are symmetric to the pin holes of the second pin hole set. For example, the VBUS GND pin hole is disposed in a position of the seventeenth pin hole of the second row symmetric to the VBUS GND pin hole that is the sixteenth pin hole of the first row. The VBUS pin hole is disposed in a position of the thirty second pin hole of the second row symmetric to the VBUS pin hole that is the first pin hole of the first row. Similarly, the eCBUS#1/ID pin hole and the eCBUS#1 GND pin hole are respectively disposed in positions of the eighteenth and nineteenth pin holes of the second row symmetric to the eCBUS#0/ID pin hole and the eCBUS#0 GND pin hole that are fifteenth and fourteenth pin holes of the first row, respectively. As to the pin holes that transmit and receive AV data, the Data0/1+ pin hole, the Data0/1− pin hole, and the Data0/1 GND pin hole are respectively disposed in positions of twentieth, twenty first, and twenty second pin holes symmetric to the Data1/0+ pin hole, the Data1/0− pin hole, and the Data1/0 GND pin hole that are thirteenth, twelfth, and eleventh pin holes, respectively.

The connector plug 100 may be combined or inserted into the connector socket 200 in formats as shown in FIGS. 5 and 6 or the connector plug 100 may rotate 180 degrees to be combined or inserted into the connector socket 200. In this case, according to an exemplary embodiment, the seventeenth pin, the thirty second pin, the first pin, and the sixteenth pin of the connector plug 100 are respectively combined into the sixteenth pin hole, the first pin hole, the thirty second pin hole, and the seventeenth pin hole of the connector socket 200.

If the connector plug 100 is combined or inserted into the connector socket 200, the connector socket 200 receives AV data according to a direction in which they were combined. If the connector plug 100 is combined or inserted into the connector socket 200 in formats as shown in FIGS. 5 and 6, the Data1/0+ pin hole, the Data1/0− pin hole, and the Data1/0 GND pin hole respectively receive data of the Data1+ pin, the Data1− pin, and the Data1 GND pin. However, if the connector plug 100 rotates 180 degrees to be combined or inserted into the connector socket 200, the Data1/0+ pin hole, the Data1/0− pin hole, and the Data1/0 GND pin hole respectively receive data of the Data0+ pin, the Data0− pin, and the Data0 GND pin.

According to various exemplary embodiments described above, a connector structure may be provided to improve ease of use and to efficiently transmit and receive high-capacity data.

The foregoing exemplary embodiments are merely exemplary and are not to be construed as limiting. The description of exemplary embodiments is intended to be illustrative, and not to limit the scope of the claims, and many alternatives, modifications, and variations will be apparent to those skilled in the art. It would be apparent to those skilled in the art that changes may be made in exemplary embodiments without departing from the principles and spirit of an inventive concept, the scope of which is defined in the appended claims and their equivalents.

What is claimed is:

1. A connector plug comprising:

a first pin set, which is positioned in a first row of the connector plug, and is configured to transmit and receive a first data signal; and a second pin set, which is positioned in a second row of the connector plug, and is configured to transmit and receive a second data signal, wherein a plurality of pins of the first pin set, which are of same type as a plurality of pins of the second pin set, are positioned symmetrically with respect to the plurality of pins of the second pin set, wherein the first row is arranged below or above the second row, and wherein both ends of the first pin set mismatch both ends of the second pin set.

2. The connector plug of claim 1, wherein each of the first and second pin sets comprises:

a first pin configured to transmit and receive a power signal;

a second pin configured to transmit and receive a control signal; and at least two differential pair pin sets configured to transmit and receive an audio and/or video (AV) data signal.

3. The connector plug of claim 2, wherein each of the at least two differential pair pin sets comprises a + signal pin, a − signal pin, and a ground pin.

4. The connector plug of claim 3, wherein the + signal pin, the − signal pin, and the ground pin are sequentially arranged.

5. The connector plug of claim 3, wherein the ground pin of the second row of the connector plug is positioned between the + signal pin and the − signal pin of the first row of the connector plug.

6. The connector plug of claim 2, wherein the second pin transmits and receives at least one of a control signal, an identification signal, and a combination direction determination signal.

7. The connector plug of claim 2, wherein the at least two differential pair pin sets comprise eight differential pair pin sets configured to transmit and receive data at approximately 20 gigabits (Gb) per second.

8. The connector plug of claim 2, wherein each of the first and second pin sets further comprises pins that comply with a universal serial bus (USB) standard.

9. The connector plug of claim 1, wherein the first pin set is configured to be inserted into a first hole set of a connection socket and into a second hole set of the connection socket and wherein the first and second pin sets support transmission and reception of a three-dimensional image.

10. The connector plug of claim 1, wherein the first and second pins sets are configured to support USB signals and AV signals.

11. The connector plug of claim 1, wherein each of the first pin set and the second pin set comprises: a volumetric bladder ultrasound (VBUS) ground (GND) pin configured to transmit and receive a ground signal, an eCBUS pin configured to transmit and receive a first control signal, and an eCBUS GND pin.

12. A connector socket comprising:

a first pin hole set, which is positioned in a first row of the connector socket, and is configured to transmit and receive a first data signal;

a second pin hole set, which is positioned in a second row of the connector socket, and is configured to transmit and receive a second data signal, wherein a plurality of pin holes of the first pin hole set, which are of same type as a plurality of pin holes of the second pin hole set, are positioned symmetrically with respect to the plurality of pin holes of the second pin hole set, wherein the first row is arranged below or above the second row, and wherein both ends of the first pin hole set mismatch both ends of the second pin hole set.

13. The connector socket of claim 12, wherein each of the first and second pin hole sets comprises:

a first pin hole configured to transmit and receive a power signal;

a second pin hole configured to transmit and receive a control signal; and at least two differential pair pin hole sets configured to transmit and receive an AV data signal.

14. The connector socket of claim 13, wherein each of the at least two differential pair pin hole sets comprises a + signal pin hole, a − signal pin hole, and a ground pin hole.

15. The connector socket of claim 14, wherein the + signal pin hole, the − signal pin hole, and the ground pin hole are sequentially arranged.

16. The connector socket of claim 14, wherein the ground pin hole of the second row of the connector socket is positioned between the + signal pin hole and the − signal pin hole of the first row of the connector socket.

17. The connector socket of claim 13, wherein each of the first and second pin hole sets further comprises pin holes that comply with a USB standard.

18. The connector socket of claim 13, wherein the second pin hole transmits and receives at least one of a control signal, an identification signal, and a combination direction determination signal.

19. The connector socket of claim 13, wherein the at least two differential pair pin hole sets comprise eight differential pair pin hole sets configured to transmit and receive data at approximately 20 gigabits (Gb) per second.

20. A connector plug comprising:

a first row pin set; and a second row pin set, wherein the first row pin set comprises:

a first volumetric bladder ultrasound (VBUS) ground (GND) pin configured to transmit and receive a first ground signal;

a first eCBUS pin configured to transmit and receive a first control signal;

a first eCBUS GND pin;

a Data1/0+ pin configured to transmit and receive one of first audio and/or video (AV) data and second AV data at a speed higher than six gigabits (Gb) per second;

a Data1/0− pin;

a Data1/0 GND pin;

a universal serial bus (USB)#0 D+ pin configured to transmit and receive a first data signal according to a USB standard;

a USB#0 D− pin;

a USB#0 GND pin;

a Data2/3+ pin configured to transmit and receive one of third AV data and fourth AV data at the speed;

a Data2/3− pin;

a Data2/3 GND pin;

a Data4/5+ pin configured to transmit and receive one of fifth AV data and sixth AV data;

a Data4/5− pin;

a Data4/5 GND pin; and a second VBUS pin configured to transmit and receive a power signal of second power;

wherein the second row pin set comprises:

a first VBUS pin configured to transmit and receive a power signal of first power;

a Data5/4 GND pin configured to transmit and receive one of the sixth AV data and the fifth AV data at the speed;

a Data5/4− pin;

a Data5/4+ pin;

a Data3/2 GND pin configured to transmit and receive one of the fourth AV data and the third AV data at the speed;

a Data3/2− pin;

a Data3/2+ pin;

a USB#1 GND pin configured to transmit and receive a second data signal according to a USB standard;

a USB #1 D− pin;

a USB #1 D+ pin;

a Data0/1 GND pin configured to transmit and receive one of the second AV data and the first AV data at the speed;

a Data0/1− pin;

a Data0/1+ pin;

a second eCBUS GND pin configured to transmit and receive a ground signal of a second control signal;

a second eCBUS pin configured to transmit and receive the second control signal; and a second VBUS GND pin configured to transmit and receive a second ground signal of the second power.

* * * * *